US009291958B2

(12) United States Patent
Nakamoto et al.

(10) Patent No.: US 9,291,958 B2
(45) Date of Patent: Mar. 22, 2016

(54) IMAGE HEATING APPARATUS, HEATER AND BELT REPLACING METHOD

(71) Applicant: CANON KABUSHIKI KAISHA, Tokyo (JP)

(72) Inventors: Ikuo Nakamoto, Matsudo (JP); Shigeru Hirano, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/704,017

(22) Filed: May 5, 2015

(65) Prior Publication Data

US 2015/0323890 A1 Nov. 12, 2015

(30) Foreign Application Priority Data

May 7, 2014 (JP) ..... 2014-095811
Apr. 22, 2015 (JP) ..... 2015-087912

(51) Int. Cl.
*G03G 15/20* (2006.01)

(52) U.S. Cl.
CPC ..... *G03G 15/2028* (2013.01); *G03G 15/2025* (2013.01); *G03G 15/2075* (2013.01)

(58) Field of Classification Search
CPC ..... G03G 15/2025; G03G 15/2075
USPC ..... 399/68
See application file for complete search history.

(56) References Cited

U.S. PATENT DOCUMENTS 5,278,617 A * 1/1994 Boisvert ..... G03G 15/2025 118/258
7,200,354 B2 4/2007 Nakamoto et al.
7,406,288 B2 7/2008 Nakamoto et al.
7,457,576 B2 11/2008 Takada et al.
7,466,950 B2 12/2008 Matsuura et al.
7,542,711 B2 6/2009 Nakamoto et al.
7,596,348 B2 9/2009 Nakamoto et al.
7,792,477 B2 9/2010 Nakamoto et al.
7,844,208 B2 11/2010 Hayashi et al.
8,554,097 B2 10/2013 Hara et al.
2005/0169678 A1* 8/2005 Baskin ..... G03G 15/2025 399/324
2011/0052245 A1* 3/2011 Shinshi ..... G03G 15/205 399/92
2014/0119787 A1* 5/2014 Hasegawa ..... G03G 15/2064 399/329

FOREIGN PATENT DOCUMENTS

JP 2004-047177 2/2004
JP 2013-114056 6/2013

* cited by examiner

*Primary Examiner* — David Gray
*Assistant Examiner* — Tyler Hardman
(74) *Attorney, Agent, or Firm* — Fitzpatrick, Cella, Harper & Scinto

(57) ABSTRACT

An image heating apparatus includes: an endless belt; a heater for heating the belt, the heater forms a sliding portion between an inner surface of the belt and the heater; a rotatable member cooperative with the heater to sandwich the belt to form a nip between an outer peripheral surface of the belt and the rotatable member; a temperature detector provided on a surface of the heater relatively more remote from the sliding portion than the heater; a controller for controlling the timing of feeding the sheet to the nip on the basis of an output of the detector; and lubricant provided in at least a part of the sliding portion except for a range which is in an opposing relation with the detector. The sliding portion is free of the lubricant in the range.

18 Claims, 9 Drawing Sheets

| AMOUNT OUTSIDE OF THMSTR PORTION (mg/mm) | THMSTR PORTION | | FIXING PROPERTY | SLIP |
|---|---|---|---|---|
| | APPLICATION AREA (mm) | AMNT (mg/mm) | | |
| 2.5 | 0 (UNIFORM) | 2.5 | × | O |
| 2.5 | 5 | 0.5 | × | O |
| 2.5 | 10 | 0.5 | O | O |
| 2.5 | 30 | 0.5 | O | O |
| 2.5 | 70 | 0.5 | O | O |
| 2.5 | 80 | 0.5 | O | × |
| 0.5 | 0 (UNIFORM) | 0.5 | O | × |

IMAGE HEATING APPARATUS, HEATER AND BELT REPLACING METHOD

FIELD OF THE INVENTION AND RELATED ART

The present invention relates to a belt for heating an image on a sheet of a recording medium, a heater for heating a belt, an image heating apparatus having the preceding belt and heater, and a method for replacing a belt. An image heating apparatus is employed by an image forming apparatus such as a copying machine, a printer, a facsimile machine, and a multifunction apparatus having two or more of the functions of the preceding apparatuses.

An image forming apparatus forms an image of toner, on a sheet of a recording medium, and fixes the image to the sheet by the application of heat and pressure with the use of its fixing device (image heating device). As fixing device used for the above described purpose, there has been proposed a fixing device which has a cylindrical fixation film and a heater, and gives the heat from the heater to the sheet through the fixation film (belt), by placing the heater in contact with the inward surface of the fixation film (Japanese Laid-open Patent Application 2004-47177). A fixing device which uses the above-described heating method is small in thermal capacity because of its structure. Therefore, it can be quickly started up in terms of temperature.

The fixing device disclosed in Japanese Laid-open Patent Application 2004-47177 is provided with a temperature detection element, which is disposed on the opposite surface of its heater from the surface of the heater, which contacts the fixation belt. This fixing device controls the temperature of its heater by controlling the electric power supply to the heater, based on the temperature detected by the temperature detection element. Further, the fixing device disclosed in Japanese Laid-open Patent Application 2004-47177 forms a nip between its fixation film and pressure roller, by placing the pressure roller in contact with the outward surface of the fixation film. Also in the case of this fixing device, as the pressure roller rotates by receiving a driving force from the driving section, friction occurs between the pressure roller and the fixation film, providing thereby the fixation film with rotational force. The fixation film is loosely fitted around the heater holder. Thus, as the fixation film receives the above described rotational force, it circularly moves while sliding on the bottom surface of the heater.

It is also disclosed in Japanese Laid-open Patent Application 2004-47177 that a layer of lubricant, such as heat resistant grease or the like, is placed between the fixation film and the heater to reduce the friction between the fixation film and the heater. There is no detailed description about how to place a layer of lubricant, in Japanese Laid-open Patent Application 2004-47177. However, if the placement of lubricant between the fixation film and the heater is intended to reduce the friction between the fixation film and the heater, it is reasonable to think that the entirety of the area of contact between the fixation film and the heater should be provided with lubricant.

However, if lubricant is evenly spread between the belt and the heater of a fixing device, across the entirety of area of contact between the belt and the heater, it becomes difficult to control the fixing device in temperature, based on the temperature information which a temperature detection element on the heater detects. To describe in greater detail, if lubricant is coated between the belt and the heater across the entirety of area of contact between the belt and the heater, the heat transmission between the belt and temperature detection element is impeded by the lubricant, and therefore, it is likely for the temperature detected by the temperature detection element to be different from the actual temperature of the belt. Therefore, in a case where the fixation temperature of a fixing device is controlled based on the temperature detected by the temperature detection element to heat an image on a sheet of a recording medium, it is possible that the toner image on the sheet is likely to be heated by the belt, the temperature of which is offset from the target level for the fixation temperature, and therefore, unsatisfactory images will be outputted.

SUMMARY OF THE INVENTION

Thus, the primary object of the present invention is to provide an image heating apparatus capable of preventing the outputting of unsatisfactory images.

Another object of the present invention is to provide a heater, a belt, and a belt replacing method, which can provide the same effects.

According to an aspect of the present invention, there is provided an image heating apparatus comprising: an endless belt configured to heat an image on a sheet in a nip; a heater configured to heat the belt, the heater being cooperative with the belt to form a sliding portion between an inner surface of the belt and the heater; a rotatable member cooperative with the heater to sandwich the belt to form the nip between an outer peripheral surface of the belt and the rotatable member; a detecting member provided on a surface of the heater relatively remoter from the sliding portion and configured to detect a temperature of the heater; a controller configured to control the timing of feeding the sheet to the nip on the basis of an output of the detecting member; and lubricant provided in at least a part of the sliding portion except for a range which is in opposing relation with the detecting member. The sliding portion is free of the lubricant in the range.

According to an aspect of the present invention, there is provided an image heating apparatus comprising: an endless belt configured to heat an image on a sheet in a nip; a heater configured to heat the belt, the heater being cooperative with the belt to form a sliding portion between an inner surface of the belt and the heater; a rotatable member cooperative with the heater to sandwich the belt to form the nip between an outer peripheral surface of the belt and the rotatable member; a detecting member provided on a surface of the heater relatively remoter from the sliding portion and configured to detect a temperature of the heater; a controller configured to control the timing of feeding the sheet to the nip on the basis of an output of the detecting member; and lubricant provided in at least a part of the sliding portion except for a range which is in opposing relation with the detecting member. The sliding portion is free of the lubricant in the range. These and other objects, features, and advantages of the present invention will become more apparent upon consideration of the following description of the preferred embodiments of the present invention, taken in conjunction with the accompanying drawings.

DESCRIPTION OF THE EMBODIMENTS

Hereinafter, the present invention is concretely described with reference to some of the preferred embodiments of the present invention. By the way, these embodiments are nothing but examples of embodiments of the present invention. That is, they are not intended to limit the present invention in scope. In other words, the present invention can be embodied in various forms, which are different from the following embodiments, within the scope of the present invention.

Embodiment 1

Image Forming Apparatus

Figure 2:
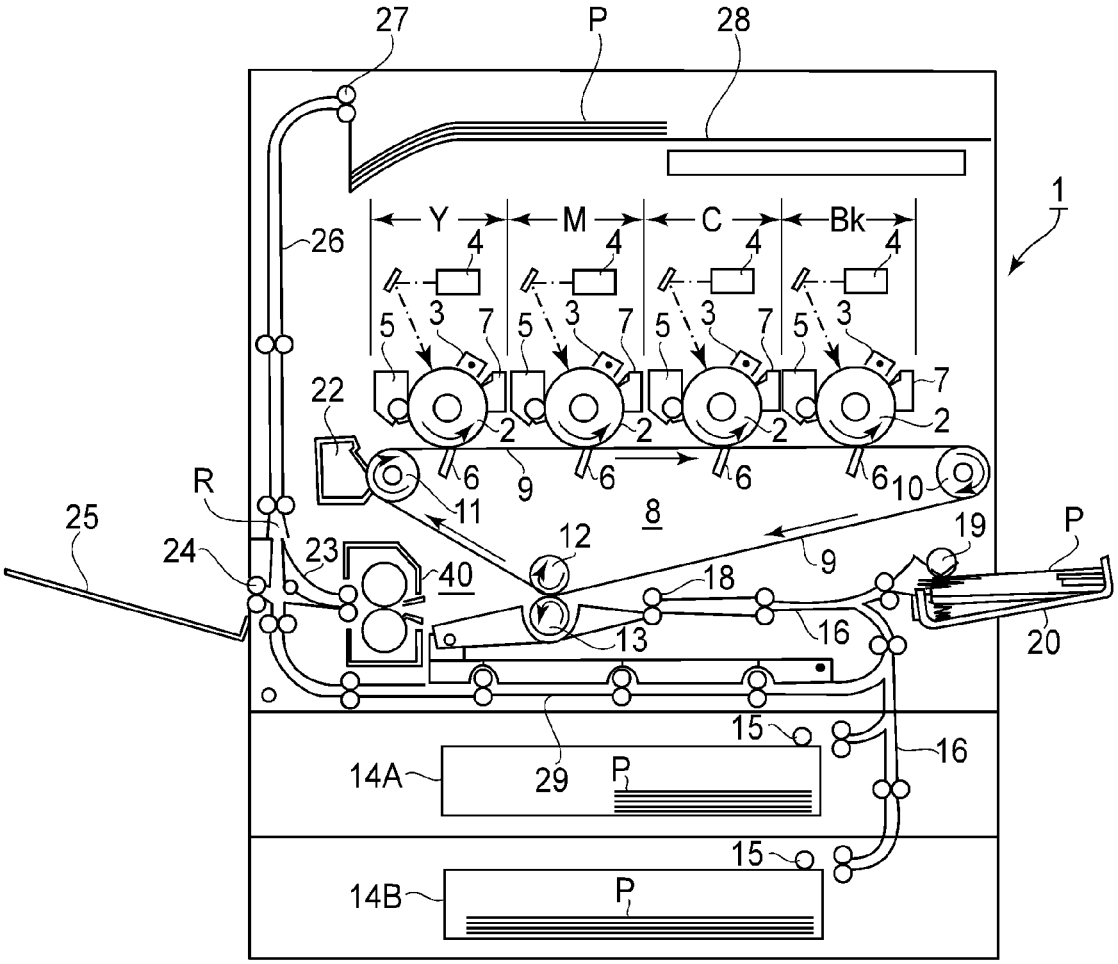
FIG. 2 is a schematic sectional view of the image forming apparatus in the first embodiment, and shows the structure of the apparatus.

FIG. 2 is a schematic vertical sectional view of the electrophotographic color printer 1 in this embodiment, which is an example of an image forming apparatus. It shows the structure of the printer 1. There are disposed four image formation sections Y, M, C and Bk in the printer 1. The four image formation sections are all electrophotographic processing system of the so-called laser exposure type, and are the same in structure, although they are different in the color of the developer (toner) they store in their developing device.

Each image formation section has an electrophotographic photosensitive drum 2 (which hereafter will be referred to as a drum), which is rotationally driven in the direction (counterclockwise) indicated by an arrow mark in FIG. 2. Further, each image formation section has a primary charging device 3, a laser scanner 4, a developing device 5, a primary transfer blade 6, and a cleaner 7, which are processing means for processing the drum 2 and are disposed in the adjacencies of the peripheral surface of the photosensitive drum 2. The four image formation sections form yellow (Y), magenta (M), cyan (c) and black (Bk) toner images on their drums 2, respectively. The electrophotographic image formation principle and its process are well-known, and therefore, are not described here.

The toner image formed on the photosensitive drum 2 in each image formation section is transferred onto an intermediary transfer belt unit 8 of the image formation section. To describe this process in detail, four monochromatic toner images, different in color, are formed by the four image formation sections, one for one, and are sequentially transferred (primary transfer) onto a transfer belt 9, as an intermediary transferring member, which is circularly moving in the direction (clockwise direction) indicated by an arrow mark in FIG. 2. Thus, a full-color toner image is formed of the four unfixed monochromatic yellow (M), magenta (M), cyan (C) and black (Bk) toner images, on the transfer belt 9. The unit 8 has a driver roller 10, a tension roller 11, and a belt backing roller (which opposes secondary transfer roller 12), by which the transfer belt 9 is suspended, and with which the transfer belt 9 is provided with a preset amount of tension. Against the roller 12, the primary transfer roller 13 is pressed with the presence of the transfer belt 9 between the two rollers 12 and 13.

Meanwhile, as the sheet feeding roller 15 of one of the pair of sheet cassettes 14A and 14B, or the sheet feeding roller 19 of a universal sheet feeding tray, is driven, the sheets P of a recording medium are fed into the main assembly of the printer 1, one by one, while being separated from the rest, and are conveyed to a pair of registration rollers 18 through a recording medium conveyance passage 16. The roller pair 18 sends each sheet P to the secondary transfer section, which is formed between the transfer belt 9 and roller 13 by the pressing of the roller 13 against the belt backing roller 12, in synchronism with the arrival of the toner images on the belt 9 at the secondary transfer nip. Thus, the synthetic full-color image on the transfer belt 9, which is made up of the four monochromatic toner images, different in color, is transferred onto the sheet, in the secondary transfer section; four monochromatic toner images are transferred together onto the sheet.

As the sheet P comes out of the secondary transfer section, it is separated from the surface of the transfer belt 9, and is guided into a fixing device 40 as an image heating apparatus. The toner images, different in color, on the sheet P is subjected to heat and pressure by the fixing device 40. Thus, they melt and mix. Then, they become fixed to the surface of the sheet P, thereby becoming a solid full-color image. After the toner images are separated from the transfer belt 9 in the second transfer section, the transfer belt 9 is cleaned by the belt cleaner 22, and is repeatedly used for image formation.

When the printer 1 is in the one-sided print mode, as the sheet P is moved out of the fixing device 40, it is discharged from the printer 1 through one of the recording medium conveyance passages preset for various printing jobs. To describe this process in detail, the sheet P is directed by a flapper 23 so that the sheet P will be conveyed to a tray 25, which is such a tray that as the sheet S is discharged into the tray 25, it faces upward, or a tray 28, which is such a tray that as the sheet S is discharged into the tray 28, it faces downward. Then, the sheet S is discharged onto one of the trays by a pair of discharge rollers 27 or 24.

When the printer 1 is in the two-sided mode, as the sheet P comes out of the fixing device 40, it is directed by the flapper 23 to a recording medium conveyance passage 26. Then, it is guided upward by the passage 26. As the trailing edge of the sheet P reaches the reversal point R, the recording medium conveyance passage 26 begins to convey the sheet P in the opposite direction from the direction in which the sheet P was conveyed to the reversal point. That is, the sheet P is conveyed into the recording medium conveyance passage 29, which is for the two-sided mode. Then, the sheet P enters for the second time into the recording medium conveyance passage 16 from the recording medium conveyance passage 29. When the sheet P is conveyed into the passage 16 after the first fixation, the sheet P has been turned over. Thus, while the sheet P is conveyed through the secondary transfer section for the second time, an unfixed toner image is transferred onto the second surface of the sheet P. As the sheet comes out of the secondary transfer section, it is guided into the fixing device 40 for the second time.

Thus, the sheet P having an image on both of its surfaces is discharged from the fixing device 40. As the sheet P is discharged from the fixing device 40, it is discharged from the printer 1 through one of the sheet passages preset for various jobs one for one.

<Fixing Device>

Figure 1:
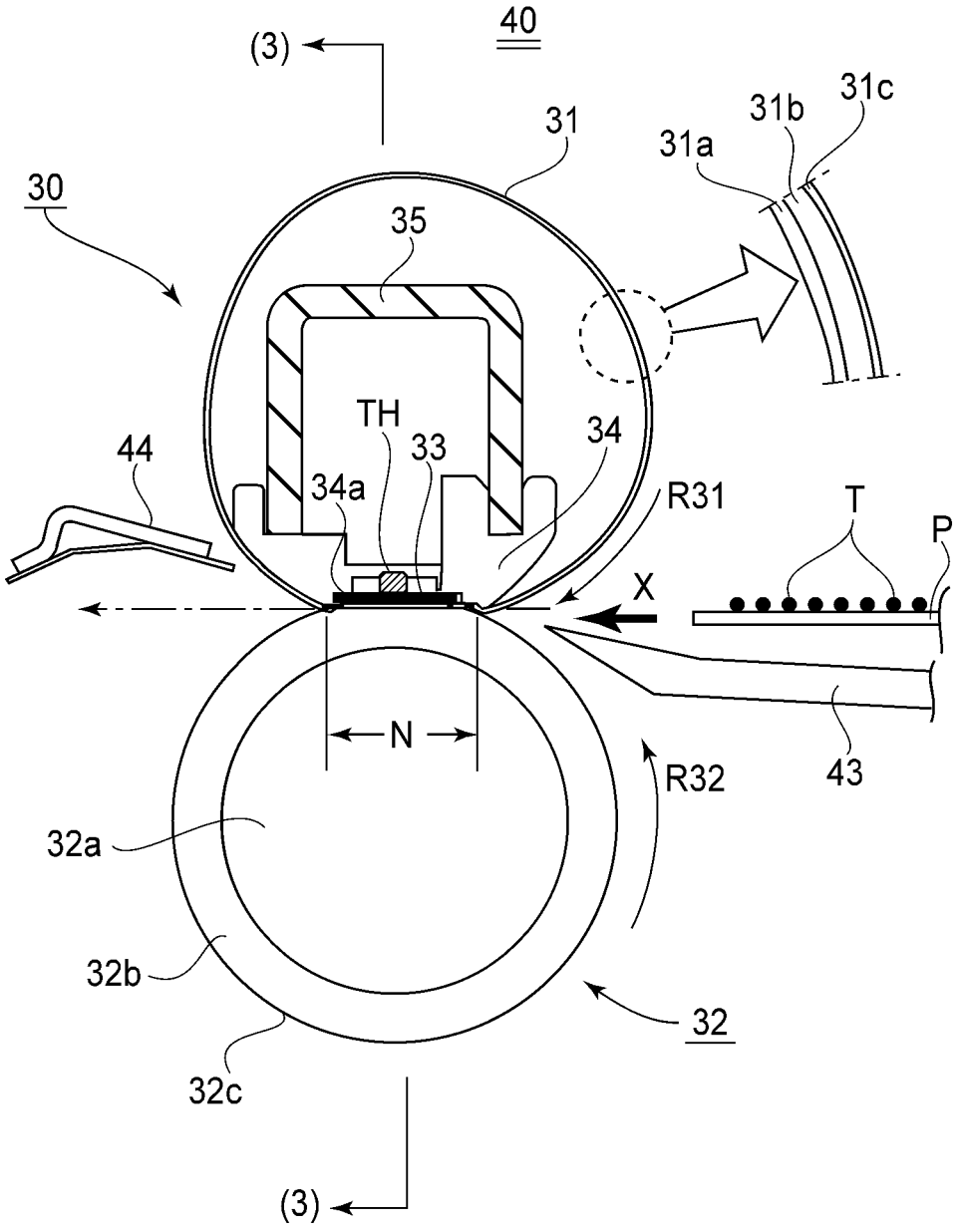
FIG. 1 is a schematic sectional view of the essential section of the fixing device in the first embodiment of the present invention.
Figure 3:
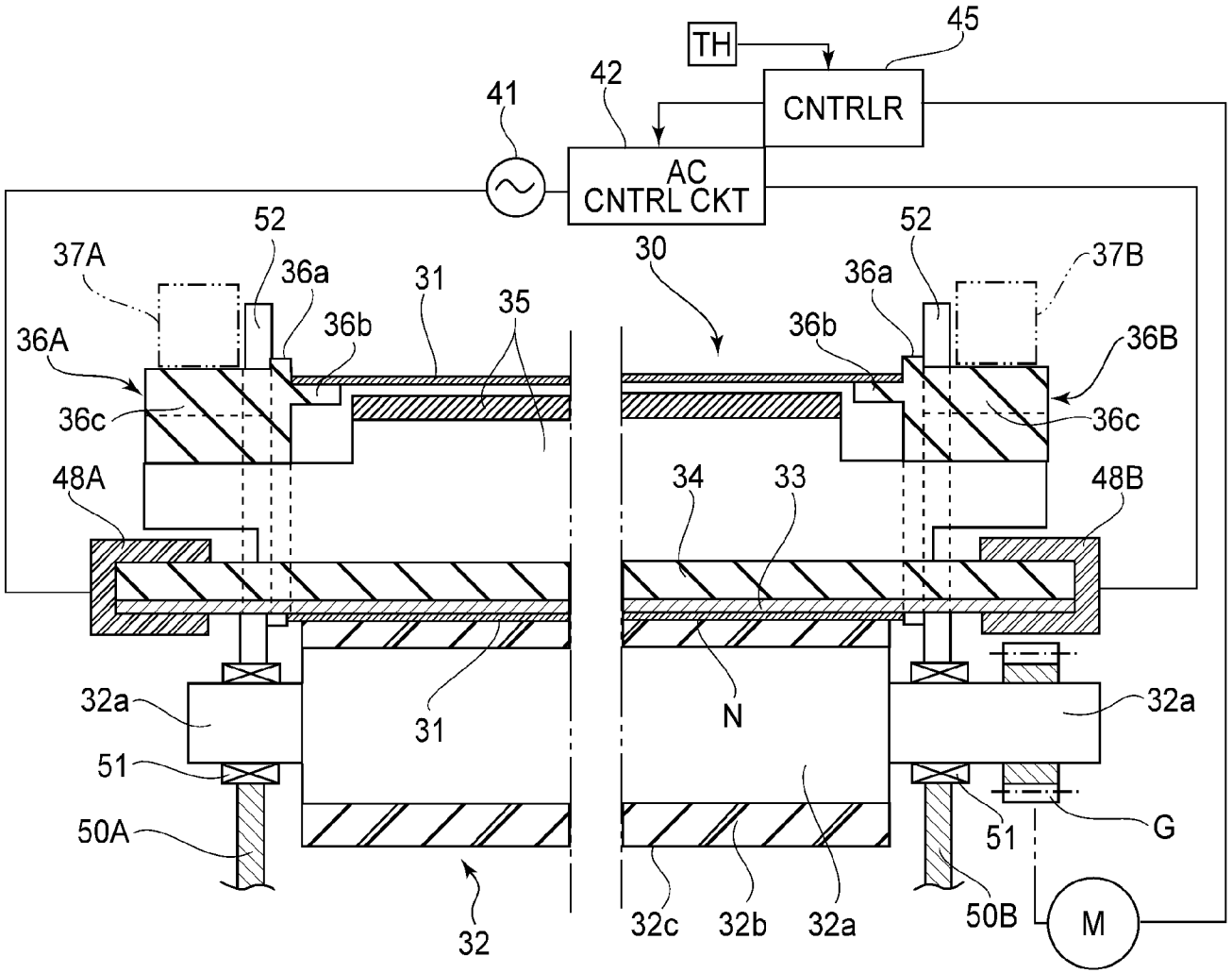
FIG. 3 is a schematic vertical sectional view of the fixing device in the first embodiment, at a plane indicated by a pair of arrow marks (3), in FIG. 1, in which the center portion of the fixing device is not shown.
Figure 4:
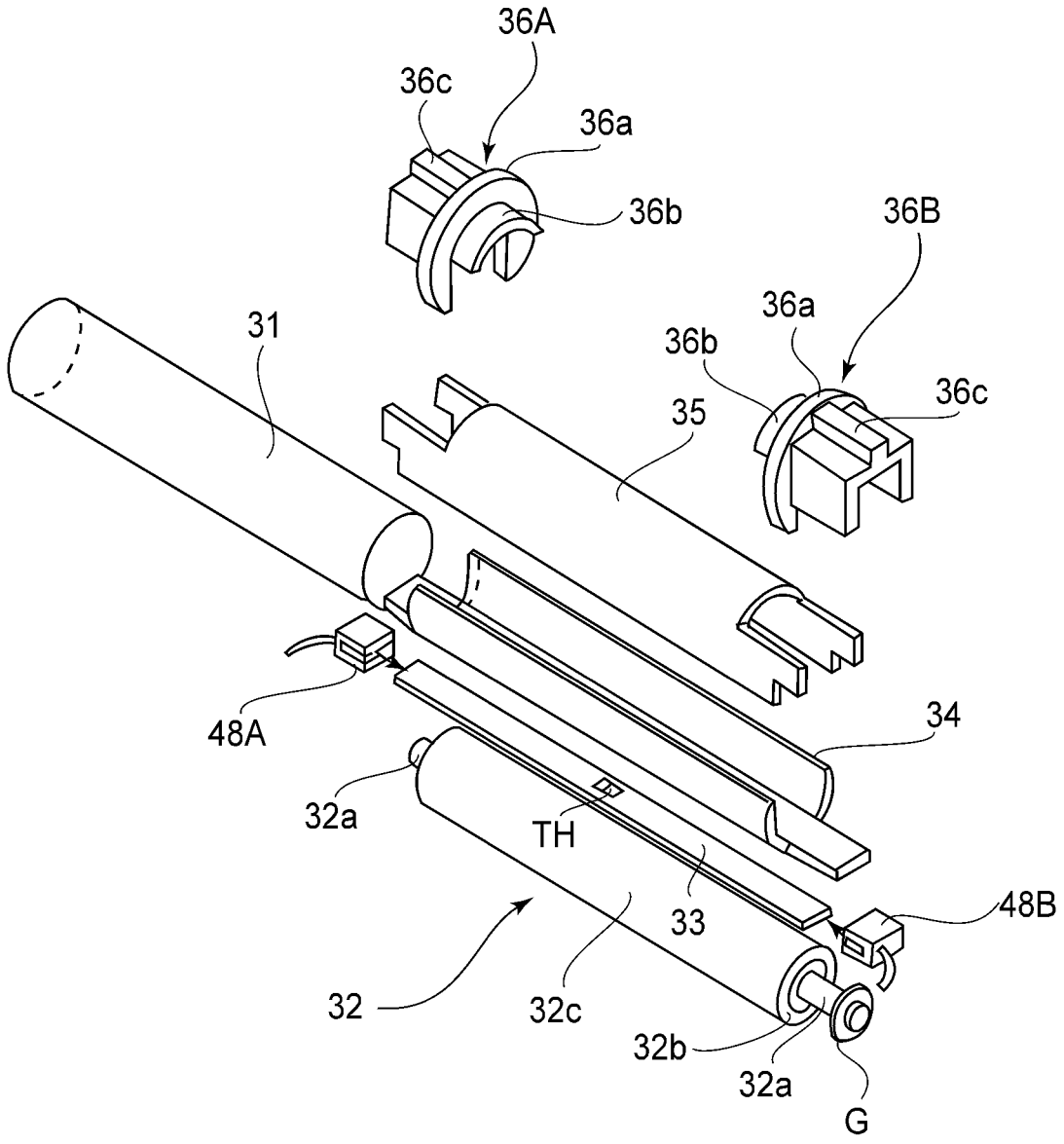
FIG. 4 is an exploded perspective view of the essential portions of the fixing device.

FIG. 1 is a schematic cross-sectional view of the essential portion of the fixing device 40. FIG. 3 is a vertical sectional view of the essential portion of the fixing device 40, at the plane indicated by a pair of arrow marks (3) in FIG. 1, which does not show certain portions of the fixing device 40. FIG. 4 is an exploded perspective view of the essential portion of the fixing device 40.

The fixing device 40 is a long and narrow device. That is, it is such a device that its lengthwise direction is parallel to the direction which is perpendicular to the direction X in which a sheet P of a recording medium is conveyed through the nip N (fixation nip). The fixing device 40 has a belt unit 30, which is equipped with a fixation belt 31 (fixing member: it will be referred to simply as "belt" hereafter) for heating the image on a sheet P of a recording medium, in the nip. Further, the fixing device 40 has a pressure roller 32, which forms the nip N between itself and the belt 31 in coordination with the belt 31. The belt unit 30 and the pressure roller 32 are disposed in the casing 50 (50A×50B) of the printer 1.

The belt unit 30 is an assembled combination of the belt 31, a ceramic heater 33, a guiding member 34, a pressure application stay 35, a pair of flanges 36A and 36B, etc. Here, the belt width direction (direction parallel to lengthwise direction of fixing device 40) is the direction which intersects the belt movement direction.

The belt 31 is a cylindrical (endless) flexible member. It is heat resistant, and is capable of transmitting heat to a sheet P of a recording medium. The belt 31 is loosely fitted around the guiding member 34 of the belt unit 30. The belt 31 heats the image on a sheet P of a recording medium, as will be described later. Referring to the enlarged portion of FIG. 1, the belt 31 is made up of a heat resistant substrate 31*a*, an elastic layer 31*b*, and a release layer 31*c*. The elastic layer 31*b* and release layer 31*c* are added as necessary. The substrate 31*a* is no more than 100 μm, preferably, 50 μm, and no less than 20 μm, in thickness. It is endless and is formed of such material that is created by mixing thermally conductive filler in a resinous substance such as PTFE, PFA, FEP, polyamide, PEEK, PES, PPS, etc. The release layer 31*c* is made of film, the surface of which is coated with a releasing agent. As the material for the releasing agent, PTE, PFA, FEP, and the like may be listed.

Incidentally, PTFE is an abbreviation for poly-tetrafluoroethylene, and PFA is an abbreviation for perfluoroalkoxyalkane, and FEP is an abbreviation for a copolymer of perfluoroethylene and propane. PEEK stands for polyether-etherketone, and PES stands for polyethersulfone. Further, PPS is an abbreviation for polyphenylsulfide. By the way, as the material for the substrate 31*a*, a thin metallic belt, which is made of SUS or the like and which is no more than 50 μm, and no less than 20 μm, in thickness, may be used. Further, in order to obtain color images which are virtually free of the nonuniformity attributable to fixation, the elastic layer 31*b* formed of such material that is created by adding thermally conductive filler in silicone rubber may be provided between the substrate 31*a* and release layer 31*c*.

Figure 5:
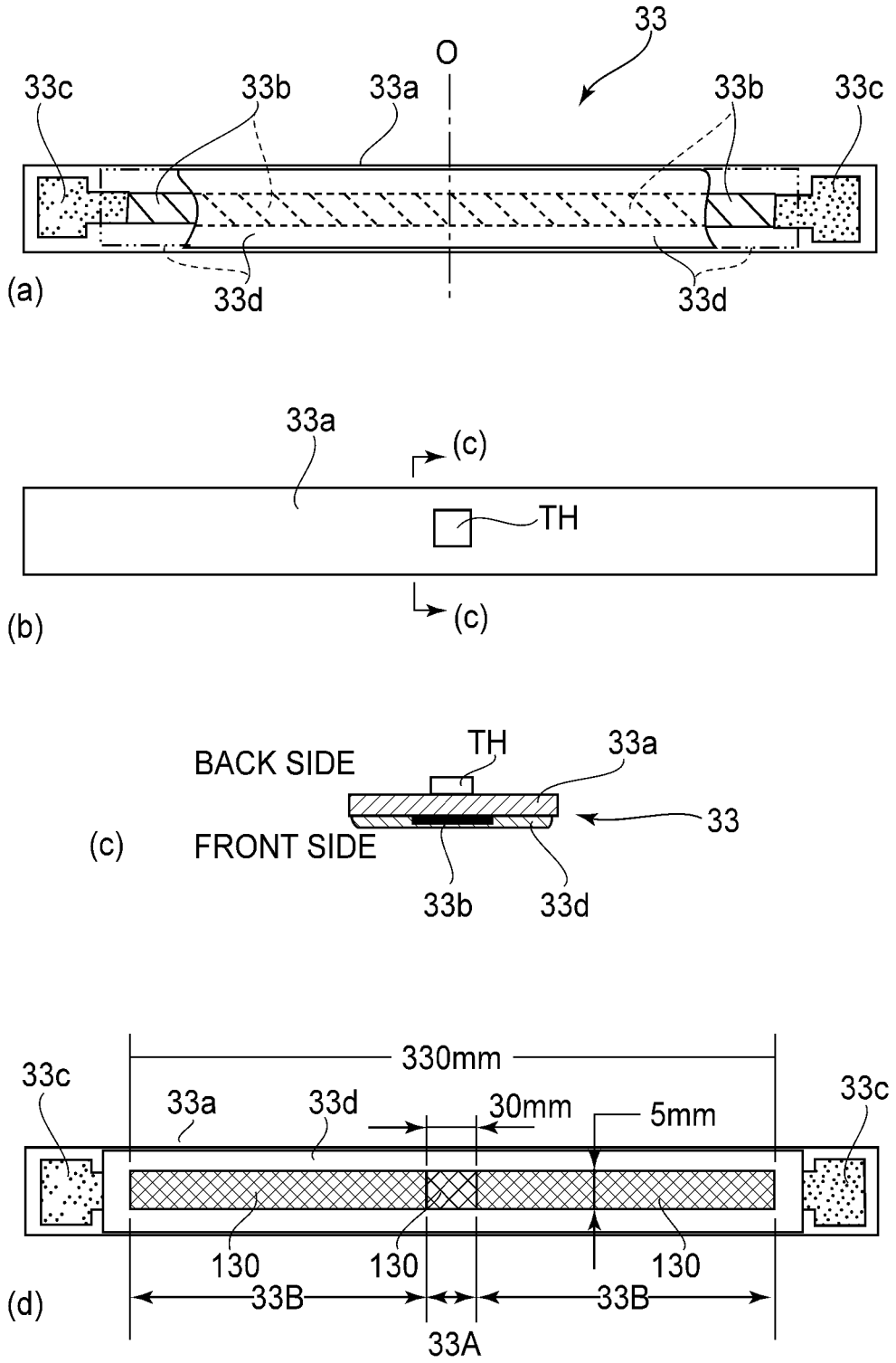
FIG. 5 is a drawing for illustrating the structure of the example of the heater.

The ceramic heater 33 (which hereafter will be referred to simply as the heater) is provided with a resistor which generates heat as electric current flows through it. It is a heating member which is small in thermal capacity. Thus, as electric current flows through it, it quickly increases in temperature. The heater 33 heats the belt 31 by being placed in contact with the inward surface of the belt 31. Thus, an area of contact is formed between the belt 31 and the inward surface of the belt 31. Here, the lengthwise direction of the heater 33 (lengthwise direction of heating member) is such a direction that intersects the belt movement direction, as will be described later. FIG. 5 shows an example of structure for the heater 33. To describe this structure in detail, FIG. 5(*a*) is a plan view of the outward surface side of the heater 33 (on which belt 31 slides), in which certain portions of the heater 33 are not shown. FIG. 5(*b*) is a plan view of the inward surface side of the heater 33. FIG. 5(*c*) is an enlarged sectional view of the heater 33, at the plane indicated by a pair of arrow marks (c) in FIG. 5(*b*).

The heater 33 has a ceramic substrate 33*a* which is long, narrow, and thin, and a resistor 33*b* which was formed on the top surface (one of surfaces) of the ceramic substrate 33*a* in such an attitude that its lengthwise direction became parallel to the lengthwise direction of the substrate 33*a*, and which generates heat as electric current flows through it. The heater 33 is also provided with a pair of electrodes 33*c* which are electrically connected to the lengthwise ends of the resistor 33*b*, one for one. The outward surface of the substrate 33*a* is covered with a protective layer 33*d* which was formed in such a shape that it does not cover the portions of the substrate 33*a*, which have the electrodes 33*c*. That is, the resistor 33*b* is covered with this protective layer 33*d*, being thereby protected. In other words, it is on the outward surface of the protective layer 33*d* of the heater 33 that the belt 31 slides.

In terms of the lengthwise direction of the heater 33, the portion of the heater 33, which corresponds in position to the resistor 33*b* which is between the pair of electrodes 33*c* which are at the lengthwise ends of the resistor 33*b*, is the effective heat generation range of the heater 33, which is 330 mm in length in this embodiment. In terms of the widthwise direction of the belt 31, the dimension of the belt 31 is roughly the same as, or slightly larger than, this effective heat generation range of the heater 33. Also, in terms of the widthwise direction of the belt 31, the dimension of the largest sheet P of a recording medium, which can be introduced into the fixing device 40, and which is conveyable through the fixing device 40, is slightly smaller than the dimension of the effective heat generation range of the heater 33.

Here, the width of a sheet P of a recording medium means the dimension of the sheet P in terms of the direction perpendicular to the sheet conveyance direction. The fixing device 40 in this embodiment is structured so that when the sheet P is conveyed through the fixing device 40, the center of the sheet P coincides with the center of the recording medium conveyance passage in terms of the widthwise direction, regardless of the sheet dimension. A reference character O stands for the centerline, with which the centerline (theoretical line) of the sheet P coincides as the sheet P is conveyed through the fixing device 40.

There is provided a thermistor TH, as a member (temperature detecting member) for detecting the temperature of the heater 33, on the inward side (opposite side of substrate 33*a* from the belt 31). To describe this structure in detail, the thermistor TH is disposed so that the temperature detecting surface of the thermistor TH contacts the inward surface of the heater 33. That is, the thermistor TH is on the opposite surface of the heater 33 from the surface of the heater 33 on which the belt 33 slides. By the way, in terms of the lengthwise direction of the heater 33, the position of the thermistor TH roughly coincides with the above described referential centerline for recording medium conveyance.

The downwardly facing surface of the guiding member 34 is provided with a heater accommodation groove 34*a* (FIG. 1), which extends in the lengthwise direction. The heater 33 is fitted in this heater accommodation groove 34*a* in such an attitude that the resistor bearing side (belt facing side: protection layer side) of the heater 33 faces outward. This is how the heater 33 is supported by the guiding member 34.

The guiding member 34 has a function of playing the role of heater holder for holding the heater 33 as described above. Further, the guiding member 34 assists the heater 33 in pressing the belt 31 toward the pressure roller 32. Moreover, the guiding member 34 has a function of a guide which stabilizes the circular movement of the belt 31. As the materials for the guiding member 34, substances which are heat resistant and thermally insulative are used. For example, they are phenol resin, polyamide resin, polyamide resin, polyamide-imide resin, PEEK resin, PES resin, PPS resin, PFA resin, PTFE resin, LCP resin, and the like. Incidentally, LCP stands for liquid polymer.

The pressure application stay 35 is a rigid member. It is long and narrow, and is U-shaped in cross section. As the materials for the pressure application stay 35, metals such as iron are used. Since the guiding member 34 is formed of resin, being therefore relatively flexible, the pressure application stay 35 supports the guiding member 34 by being pressed upon the back surface of the guiding member 34, to keep the guiding member 34 correct in shape.

The belt 31 is loosely fitted around the assembled combination of the heater 33, the guiding member 34, and the pressure application stay 35.

The flanges 36A and 36B are members with which the lengthwise ends of the pressure application stay 35 are fitted one for one. The flanges 36A and 36B have a function of guiding the belt 31 by supporting the belt 31 by the inward surface of the belt 31 as the belt 31 is circularly moved, and also, a function of regulating the belt 31 in the widthwise deviation (in the lengthwise direction, the thrust direction). The flanges 36A and 36B are a pair of members which are the same in shape, and are symmetrically positioned. They are made of heat resistant resin, for example.

Referring to FIGS. 3 and 4, the flanges 36A and 36B have an actual flange 36*a*, a rack portion 36*b*, and a pressure bearing portion 36*c*. The flange 36*a* is a portion which regulates the belt 31 in the movement in the thrust direction, by catching the belt 31 by the corresponding edge of the belt 31. Regarding the shape and size of the flanges 36A and 36B in terms of cross-sectional view, the flanges 36A and 36B are larger than the belt 31. The rack portion 36*b* is on the inward side of the pair of flanges 36*a*, and is arc-shaped in cross-section. It helps the belt 31 remain cylindrical, by being placed in contact with the lateral edges of the inward surface of the belt 31. The pressure bearing portion 36*c* is on the outward surface of the flange 36*a*, and bears the pressure applied by the pressure application mechanism 37A and 37B.

The pressure roller 32 has a metallic core 32*a*, an elastic layer 32*b*, and a release layer 32*c*. The elastic layer 32*b* is in the form of a hollow roller, and is coaxially formed around the metallic core 32*a*. As the materials for the elastic layer 32*b*, substances such as silicone rubber, fluorine rubber, fluorine resin, etc., which excels in heat resistance and elasticity, can be selected. As the material for the release layer 32*c*, substances such as fluorine resin, silicone resin, fluorosilicone resin, fluorine rubber, silicone rubber, PFA, PTFE, FEP, etc., have an excellent releasing property and heat resistance can be selected.

Referring to FIG. 3, the pressure roller 32 is disposed between the pair of side plates 50A and 50B of the apparatus casing 50. It is rotatably supported by the lengthwise ends of its metallic core 33*a*, with the placement of a pair of bearings 51 between the metallic core 32*a* and side plates 50A and 50B, one for one. The belt unit 30 is disposed between the pair of side plates 50A and 50B. It is disposed in such an attitude that its heater side faces the pressure roller 32, and also, that it is practically parallel to the pressure roller 32.

The flange 36A is fitted in the flange guiding hole 52 of the side plate 50A in such a manner that it is allowed to slide relative to the side plate 36A. The flange 36B is fitted in the flange guiding hole 52 of the side plate 50B in such a manner that it is allowed to slide relative to the side plate 36B. Further, the pair of flanges 36A and 36B are under a preset amount of pressure generated by the pressure application mechanisms 37A and 37B, respectively, in the direction to press the flanges 36A and 36B toward the pressure roller 32.

As the belt unit 30 is moved toward the pressure roller 32 by the above described pressure, the heater 31 is pressed against the pressure roller 32, with the presence of the belt 31 between the heater 33 and the pressure roller 32. Thus, the elastic layer 32*b* of the pressure roller 32 is compressed by the preset amount of pressure, against the resiliency of the elastic layer 32*b*. Thus, a nip N, which has a preset width in terms of the sheet conveyance direction X, is formed between the belt 31 and the pressure roller 32. That is, the pressure roller 32 functions as a nip forming member which works with the heater 33 to pinch the belt 31 to form the nip N between itself and belt 31.

A control circuit 45 has a function of controlling the operation of the fixing device 40. The control circuit 45 is electrically connected to an AC control circuit 42 to control the AC control circuit 42. Further, the control circuit 45 is electrically connected to a motor M to control the motor M.

Moreover, the AC control circuit 42 is electrically connected to an AC power source 41. It can provide the heater 33 with electrical current through the connectors 48A and 48B with which the lengthwise ends of the heater 33 are provided one for one.

The control circuit 45 is such a control section that controls the amount of electric current flowing though the heater 33, with the use of the AC control circuit 42, based on the temperature $T_{heat}$ detected by the thermistor TH placed in contact with the inward surface of the heater 33. That is, the control circuit 45 controls the heat generation of the heater 33 based on the output of the thermistor TH. Regarding the amount of electrical current flowing through the heater 33, the control circuit 45 sets the amount P (%) of electric current provided to the heater 33, between 0% where the heater 33 is provided with no electric current, and 100% where the heater 33 is continuously provided with electric current. As for the method for providing the heater 33 with a preset amount (%) of electric current, phase control or frequency control can be used. Further, the control circuit 45 controls the rotation of the pressure roller 32 by controlling the rotation of the motor M. To describe this structure in detail, the motor M is connected to a gear G, which is attached to the other end of the metallic core 32*a* of the pressure roller 32.

Figure 6:
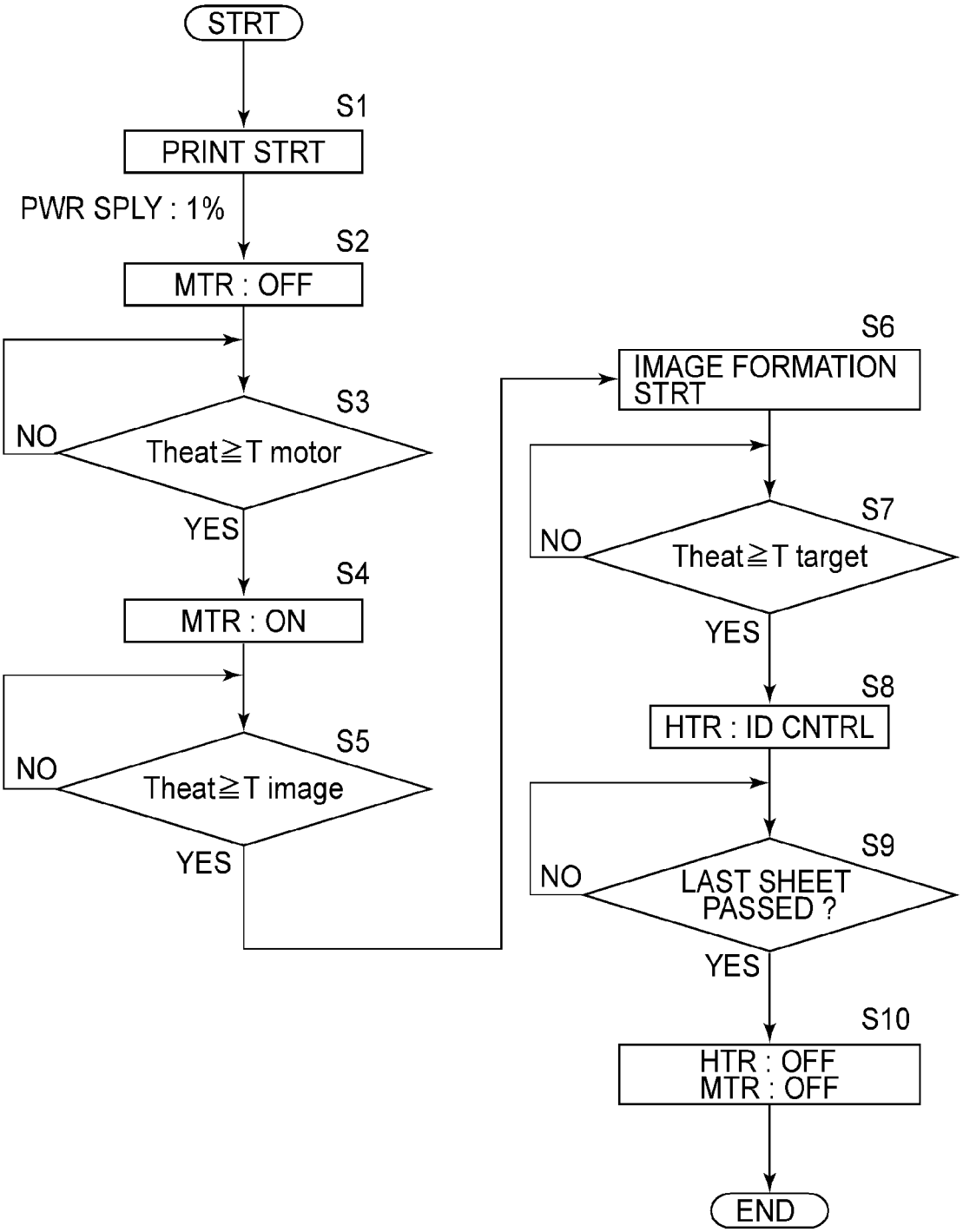
FIG. 6 is a flowchart of the fixation control.

Next, the operation carried out by the fixing device 40 during a printing operation is described. FIG. 6 is a flowchart of the fixation sequence (fixing process). As the control circuit 45 receives a print start signal (S1), it begins to supply the heater 33 with electric current by an electric current supply ratio (P1%) for start up (S2). During this period, the motor M is kept stationary. As the control circuit 45 detects that the temperature $T_{heat}$ detected by the thermistor TH is no less than the motor driving temperature $T_{motor}$ (S3), it begins to drive the motor M to rotate the motor M at a preset speed (S4).

As the motor M is driven, the pressure roller 32 is rotationally driven in the direction indicated by an arrow mark R32 (counterclockwise direction in FIG. 1). As the pressure roller 32 is rotationally driven, the belt 31 is rotated by the rotation of the pressure roller 32 in the direction indicated by an arrow mark R31 (clockwise direction in FIG. 1). During this rotational movement of the belt 31, the belt 31 slides on the heater 33 and the guiding member 34, with its inward surface remaining in contact with the heater 33 and the guiding member 34. That is, as the pressure roller 32 is rotationally driven, the belt 31 is given rotational torque by the friction which occurs between the belt 31 and the pressure roller 32 in the nip N. Thus, the belt 31 rotates around the combination of the guiding member 34 and the pressure application stay 35 at roughly the same speed as the speed of the pressure roller 32, while sliding on the combination with its inward surface remaining airtightly in contact with the combination. That is, the pressure roller 32 functions as such a rotational member that rotates the belt 31 with its rotation.

As the control circuit 45 detects that the temperature $T_{heat}$ detected by the thermistor TH is no less than the image formation start temperature $T_{image}$ (S5), it makes the image forming sections start image forming operations (S6). Next, as the control circuit 45 detects that the temperature $T_{heat}$ detected by the thermistor TH is no less than the target temperature level $T_{target}$ (S7), it switches its method for controlling the electric current supply to the heater 33, to the PID control to continue to control the heater 33 in temperature (S8).

The unfixed toner image formed through the image forming operation of the image forming section is transferred onto a sheet P of the recording medium, and is conveyed to the fixing device 40 while remaining in the state in which it was transferred onto the sheet P.

Then, the sheet P is guided into the nip N following the entrance guide 34 of the fixing device 40. Then, the sheet P is moved through the nip N along with the belt 31, with the toner image bearing surface of the sheet P remaining in contact with the outward surface of the belt 31. That is, the control circuit 45 executes such control that conveys the sheet P to the above-described nip based on the temperature detected by the thermistor TH.

While the sheet P is conveyed, remaining pinched by the pressure roller 32 and the belt 31, through the nip N, the heat generated by the heater 33 is given to the sheet P. Thus, the unfixed toner image T becomes welded to the surface of the sheet P. After being conveyed through the nip N, the sheet P is separated from the belt 31 by the curvature of the belt 31. Then, it is discharged from the fixing device 40 by a pair of discharge rollers (unshown) with which the fixing device 40 is provided. A separation guide 44 is disposed in the adjacencies of the sheet exit of the nip N. It is positioned closer to the belt 31 than the pressure roller 32. Further, the separation guide 44 is disposed so that a gap is provided between the separating edge of the separating guide 44 and the belt 31 to prevent the belt 31 from coming into contact with the separation guide 44 as the belt 31 is rotationally driven.

As soon as the control circuit 45 detects that the last sheet P of the recording medium in the on-going printing operation (printing job) has passed through the nip N (S9), it stops providing the heater 33 with electric current, and stops the motor M (S10).

<Lubricant>

In this embodiment, in order to smoothly rotate the belt 31 by reducing the friction between the belt 31 and the heater 33, and also, the friction between the belt 31 and the guiding member 34, lubricant is provided between the inward surface of the belt 31 and the heater 33. Hereafter, the area in which the belt 31 slides on the heater 33 by its inward surface will be referred to as the slide section (slide area, slide portion). The slide section is the section of the inward surface of the belt 31, which corresponds in position to the nip N which is on the outward side of the belt 31. As lubricant, heat resistant oil or grease is desirable. For example, silicone oil, PFPE (perfluoropolyether), fluorine grease, and the like can be used as lubricant. In this embodiment, fluorine grease MOLYKOTE (registered commercial name) HP-300 (product of Toray-Dow-Coring Co., Ltd.) was used as lubricant.

Hereafter, an area 33A of the outward surface (belt contacting surface) of the heater 33, on which the belt 31 slides, and which corresponds in position to the temperature detecting surface of the thermistor TH, in terms of the lengthwise direction of the heater 33, will be referred to as a thermistor area or thermistor placement area. Referring to FIG. 5, in terms of the lengthwise direction, the area 33A is wider than the temperature detection surface of the thermistor TH. Further, in terms of the lengthwise direction of the heater 33, the areas 33B of the outward surface of the heater 33, on which the belt slides, and which are the areas of the outward surface of the heater 33, which are not the area 33A (which are on the outward side of the area 33A), will be referred to as areas 33B.

In this embodiment, the belt contacting surface of the heater 33 of the fixing device 40 is coated in advance with lubricant to provide the area of contact between the belt 31 and the heater 33, when the fixing device 40 is brand-new. To describe this in detail, referring to FIG. 5(*d*), the area 33A of the belt contacting surface of the heater 33 is coated with virtually no grease 130, whereas the areas 33B are coated with a preset amount of grease 130.

The expression "coated with virtually no grease" means both "coated with no grease 130 at all", and "coated with a very small amount of lubricant".

In this embodiment, the sum of the length of the areas 33A and 33B in terms of the lengthwise direction of the heater 33 is 330 mm, which corresponds to the length of the effective heat generation range of the resistor 33*b*. Of the two areas, the area 33A (preset area, preset range) is the center portion of the heater 33 in terms of the lengthwise direction of the heater 33. It is 30 mm in length. The area 33A is coated with 15 mg of grease 130, in such a pattern that the width of the coated portion becomes 5 mm in dimension in terms of the widthwise direction of the heater 33 (sheet conveyance direction). The areas 33B (remaining area, remaining range, portions which are on the outward side of preset area 33A) are the portions of the belt contacting surface of the heater 33, which remain as the area 33A is excluded, the heater being 330 mm in dimension in terms of the lengthwise direction of the heater 33. In terms of the lengthwise direction of the heater 33, the sum of the dimensions of the two areas 33B is 300 mm. The combination of the areas 33B is coated with 750 mg of grease 130 in such a pattern that the dimension of the coated area becomes 5 mm in dimension in terms of the heater width direction (sheet conveyance direction). Incidentally, the amount of a given area of the belt contacting area of the heater 33 that is coated with grease per unit area can be obtained based on the total amount of grease coated on the given area, and the size of the given area.

That is, the amount by which the area 33A is coated with grease 130 per unit area is 0.1 mm/mm$^2$. Therefore, the total amount of grease 130 which is present on the heater 33 per 1 mm in terms of the heater length direction is 0.5 mg. That is, the amount of grease on the belt contacting area per unit length in terms of the heater length direction is 0.5 mg/mm. Hereafter, the grease 130 coated on the area 33A will be referred to as the first lubricant.

The amount of the grease, per unit area, on the portion of the area 33B coated with grease 130 is 0.5 mg/mm$^2$. Therefore, the total amount of grease 130 which is present on the area 33B per 1 mm in terms of the heater lengthwise direction is 2.5 mg/mm. That is, the amount of grease per unit length in terms of the heater length direction is 2.5 mg/mm. Hereafter, the grease coated on the areas 33B will be referred to as the second lubricant.

That is, the amount of the grease, per unit area, on the grease-coated portion of the area 33A of the belt contacting surface of the heater 33 is smaller than the amount of the grease, per unit area, on the grease-coated portion of the area 33B.

By the way, before the heater 31 is attached to the heater holder after it is coated with the grease 130, the amount of grease 130 per unit area on each area (portion) of the heater 31 can be confirmed through the following procedure. To begin with, the size of the grease-coated portion of a given area is measured. Then, the grease 130 on the given area is scraped away, and the total amount of the removed grease 130 is measured. Then, the value of the total amount of the removed grease 130 is divided by the value of the size of the given areas, to confirm the amount of the grease, per unit area, which was on the given area.

On the other hand, after the heater 31 is attached to the heater holder after it was coated with the grease 130, the amount of the grease 130, per unit area, on a given area of the heater 131 can be confirmed with the use of the following procedure. To begin with, the belt 31 is stopped at an optional point, and the belt 33 is cut to a preset depth following the contour of the heater 33. Then, the heater 31 is removed from the guiding member 34. During the removal of the heater 31, the pieces of belt 31 which have resulted from the cutting of the belt 31 following the contour of the heater 33, remain adhered to the heater 33 because of the viscosity of the grease 130. Thus, it is possible to remove only the portion of the belt 31, which was in contact with the belt contacting area of the heater 33 from the fixing device 40.

Then, the grease 130 is scraped down from the target area of the belt contacting portion, and the total amount of the removed grease 130 is measured. To describe this in detail, the grease 130 is scraped down from both the heater 33 and belt 31. Then, the amount of grease, per unit area, on the target area can be confirmed by dividing the value of the total amount of the thus collected grease by the value of the size of the target area.

Figure 7:
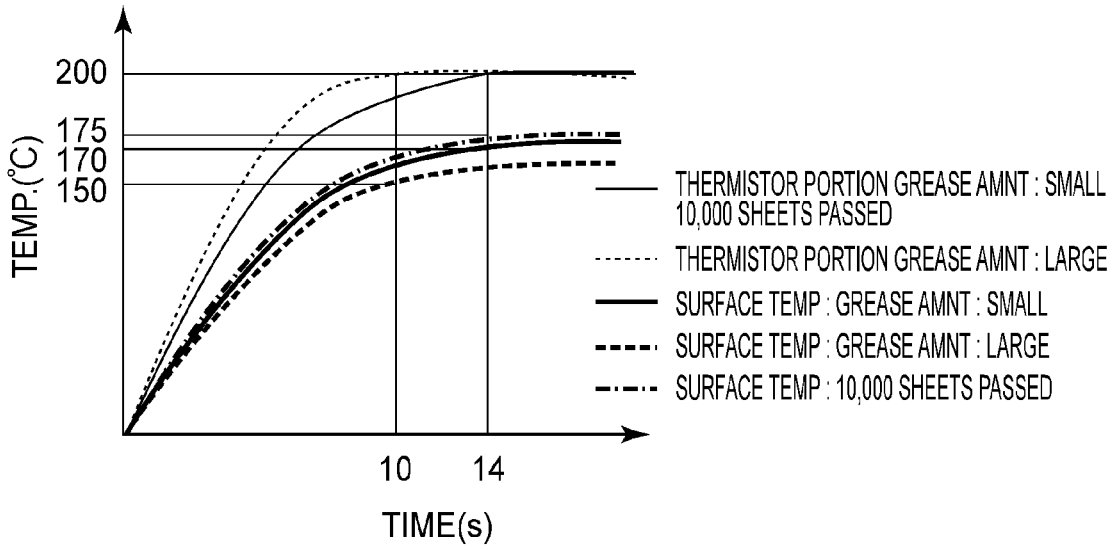
FIG. 7 is a graph which shows the temperature increase curve of the fixing device.

The surface temperature of the belt 31 of the brand-new fixing device 40 having the heater 33 in this embodiment was measured while observing the temperature $T_{heat}$ detected by the thermistor TH. FIG. 7 shows the results of the measurement; it shows the temperature increase curve. The belt temperature shown in FIG. 7 is the average temperature of the area of the belt 31, which corresponds in position to the area 33B.

FIG. 7 includes the test results of a comparative example of heater 33, which was uniformly coated in a width of 5 mm, with the grease 130 across the entirety of both the area 33A and areas 33B. More concretely, the amount of grease, per unit area, on the grease-coated area of the comparative example of heater 33 was 0.5 mg/mm$^2$. That is, the total amount of grease per 1 mm in terms of the heater length direction was 2.5 mg (2.5 mg/mm). This comparative example of heater 33 was installed in the fixing device 40, and the surface temperature of the belt 31 was measured while providing the heater 33 with electrical current and collecting the temperature $T_{heat}$ measured by the thermistor TH. FIG. 7 shows the results of the measurement; it shows the temperature increase curve.

Referring to FIG. 7, in the case of the heater 33 in this embodiment, the temperature $T_{heat}$ detected by the thermistor TH reached 200° C. 14 seconds after the heater 33 began to be supplied with electric power. In comparison, in the case of the first comparative example of the heater 33, the temperature $T_{heat}$ detected by the thermistor TH reached to 200° C. 10 seconds after it began to be supplied with electric power.

The reason why the length of time it took for the temperature Theat detected by the thermistor TH to reach 200° C. is shorter than the length of time for the heater 33 in the first comparative example of heater 33 in this embodiment is as follows. That is, the amount of grease between the area 33A of heater 33, and belt 31 in the first comparative example of the heater 33 is greater, being therefore slower in the heat transfer from the heater 33 to the belt 31, than the heater 33 in this embodiment. Therefore, the first comparative example of heater 33 increased faster in temperature than the heater 33 in this embodiment.

Referring to FIG. 7, in a case where the area 33A is smaller in the amount of grease (this embodiment), when the temperature $T_{heat}$ detected by the thermistor TH reached 200° C., the belt temperature had reached 170° C. In comparison, in the case where the entirety of both the area 33A and areas 33B are uniformly coated with the grease 130 (comparative example 1), when the temperature $T_{heat}$ detected by the thermistor TH reached 200° C., the belt temperature had reached only 150° C. The reason for the occurrence of this phenomenon is as follows. That is, in the case of the comparative example of heater 33, the amount of grease on the area 33A was greater than that in the case of the heater in this embodiment. Therefore, the heater 33 alone had increased in temperature before heat transferred from the heater 33 to the belt 31 by a sufficient amount. That is, there had occurred a large amount of difference between the temperature $T_{heat}$ detected by the thermistor TH and the surface temperature of the belt 31.

Figure 8:
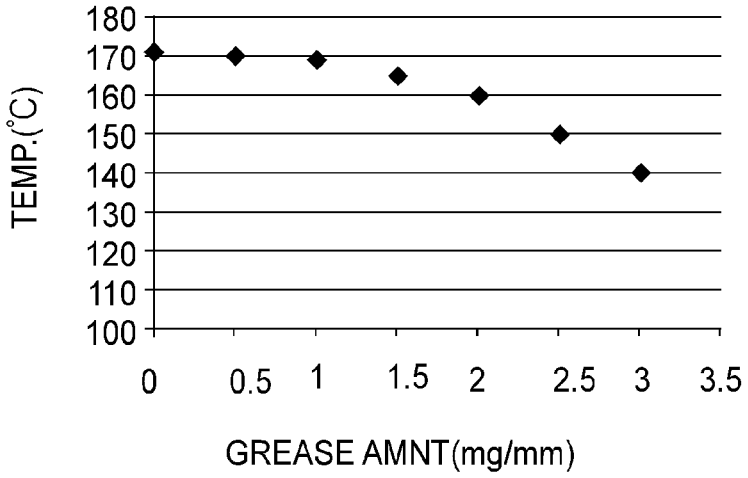
FIG. 8 is a graph which shows the changes in belt surface temperature, which occurred as the amount of grease application was changed.

In the case of the heater 33 in this embodiment, it was varied in the amount by which its area 33A was coated in advance with grease, and the belt surface temperature was measured as the temperature $T_{heat}$ detected by the thermistor TH reached 200° C. The relation between the amount of grease and the belt surface temperature is shown by the graph in FIG. 8. As will be evident from FIG. 8, as long as the amount of grease is no more than roughly 1.0 mm/mm, the presence of grease did not significantly affect the belt surface temperature. However, as the area 33A of the heater 33 was increased in the amount of grease beyond the 1.0 mg/mm, the presence of grease significantly affected the belt surface temperature; the greater the amount of grease on the area 33A, the lower the belt surface temperature. Thus, the problem that the speed with which the belt 31 increases in surface temperature is slowed by the presence of grease on the heater 33 can be prevented by setting the amount of grease applied in advance to no more than 1.0 mm/mm (no more than 0.2 mg/mm$^2$).

In this embodiment, the amount of grease 130 coating the areas per unit length was 2.5 mg/mm as described above. However, it is not mandatory that the amount is 2.5 mg/mm. It is desired that the amount of grease 130 coating the areas 33B per unit length is no less than 1.5 mm/mm and no more than 4.5 mm/mm (no less than 0.3 mg/mm$^2$ and no more than 0.9 mg/mm$^2$, per unit area). If the amount of grease 130 is no more than 1.5 mm/mm, the grease 130 cannot satisfactorily perform as a lubricant. Thus, a greater amount of torque is required to rotate the belt 31, making it possible that the belt 31 will slip. On the other hand, if the amount of grease 130 is no less than 4.5 mg/mm, the excess amount of grease 130 travels in the lengthwise direction of the heater 33, leaks at the ends of the belt 31, and soils the apparatus. That is, if the amount of grease 130 coating the areas 33B is increased beyond 4.5 mg/mm, the amount of wasted grease 130 is wasted increases.

That is, the amount, per unit area, of grease 130 coating the grease application area of the area 33A is desired to be no more than ⅔ of the amount, per unit area, by which the grease application area of the area 33B is coated with grease 130.

Figures 9, 10:
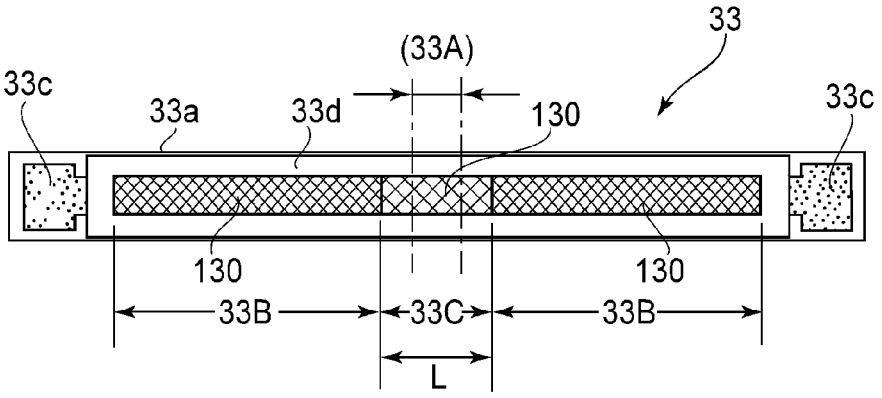
FIG. 9 is a drawing which shows another example of the pattern in which the heater is coated with lubricant.
FIG. 10 is a table which shows the summary of the results of the tests of the fixing device in the first embodiment.

FIG. 9 is a modified version of the pattern in which the heater 33 is coated with grease 130 in this embodiment. The modified version is different from the original version in the areas of the heater 33, which are coated with virtually no grease 130. That is, in the case of the modified version, in terms of the heater length direction, the preset area 33C (first area, preset area) of the belt contacting surface of the heater 33 (portion of surface of heater, on which belt 31 slides), which corresponds in position to the thermistor TH which is on the inward surface of the heater 33, is coated with virtually no grease 130. Also, in the case of the modified version, the areas 33B (second area, outward areas), that is, the other grease application areas of the heater 33 other than this preset area 33C, are coated with a preset amount of grease 130. The amount of grease 130 coating the areas 33B per unit length is desired to be no less than 1.5 mg/mm and no more than 4.5 mg/mm as it is in the above-described first embodiment.

In the modified version, the amount, per unit length, of grease 130 coating the area 33C is 0.5 mg/mm. The area 33C was varied in length (coating range). The modified versions different in the length of the area 33C were put through endurance tests. Then, the modified versions were compared in belt slippage. The results of the tests are shown in FIG. 10.

The tests for confirming the performance of the above-described fixing device which was varied in the pattern of grease application were carried out under the following conditions. That is, the sheets P of the recording medium used for the tests were of size A, and were 80 g/m$^2$ in basis weight. After the fixing devices 40 were allowed to cool down to the room temperature, 20 sheets P of the recording medium (paper), on which an unfixed solid image (toner image) was present were continuously processed by the fixing devices 40 to fix the unfixed toner image. Then, it was examined whether or not toner peeled from the sheet P.

The conditions under which the tests for finding out whether the belt 31 slips or not were carried out are as follows: roughly 100,000 sheets of a recording medium (paper) which were of size A4 and 80 g/mm$^2$ in basis weight were processed for toner image fixation by the fixing device 40. Then, a sheet P of a recording medium (paper) on which an unfixed solid image was present was processed for image fixation by the fixing device 40. Then, the finished print was examined about image disturbance. It was also examined whether or not the fixing device 40 suffered from a paper jam.

The results of the tests are as follow. As long as the length L of the area 33C which was coated with a smaller amount of grease 130 was no more than 10 mm, the fixing device 40 had no problem in fixation. However, in the case where the length L was 5 mm or less, and in the case where the amount of grease 130 coating the areas of the belt contacting surface (area) of the heater 33 was no more than 2.5 mg/mm (0.5 mg/mm$^2$ per unit area), toner peeled from the sheet P. That is, the fixing device 40 was not good in image fixation. That is, in the case where the width of the area 33C was 5 mm, as the heater 33 was attached to the heater holder, a substantial amount of grease 130 spread onto the area 33C from both edges of the area 33C, and therefore, the area 33C reduced in the thermal conductivity between the heater 33 and belt 31.

On the other hand, as long as the length L of the area 33C which was coated with a smaller amount of grease 130 is 70 mm or less, the belt slip problem did not occur. However, in the case where the length L of the area 33C was no less than 80 mm, the belt 31 slipped enough to disturb the images. As for the reason for the occurrence of this problem, the amount of grease 130 that spreads onto the area 33C from both ends (from areas 33B) was relatively small compared to the size of the area 33C. Therefore, the friction between the area 33C of the heater 33 and the belt 31 was relatively high. That is, if the areas of the heater 33, which are to be coated by a very small amount of grease 130, is excessive in terms of the length L, the amount of grease 130 required to spread onto the area 33C from the areas 33B is insufficient. By the way, it has been confirmed that in a case where the entirety of both the area 33C and the areas 33B is uniformly coated with the grease 130 by only 0.5 mg/mm (0.1 mg/mm$^2$ per unit area), the belt 31 slips due to the insufficiency in the amount of grease 130.

It is evident from the results described above that the following effects can be obtained by reducing the amount of grease 130 coating the area 33C in advance, and setting the length L of the area 33C which is coated with a very small amount of the grease 130, to a value within a range of 10 mm-70 mm (10 mm≤L≤70) (setting ratio of L to length of effective heat generation range of heater 33 to be no less than 3% and no more than 21%). That is, according to this embodiment, it is possible to prevent the occurrence of the belt slip attributable to the increase in the amount of torque necessary to rotate the belt 31. Further, according to this embodiment, even in a case where the belt contacting portion of the heater 33 is coated with the grease 130 to prevent the belt 31 from slipping, it is possible to prevent the difference between the belt temperature detected by the thermistor TH and the actual belt surface temperature from becoming substantial. Therefore, it is possible to prevent the occurrence of unsatisfactory fixation.

By the way, the method for replacing the belt of the fixing device 40 having the heater 33 in this embodiment is as follows.

To begin with, the belt unit 30 is removed from the casing 50 of the fixing device 40. Then, either flange 36A or 36B is removed. With the flange 36A or 36B removed, it is possible to remove the used belt 31 fitted around the combination of the guiding member 34 by which the heater 33 is held, and the pressure application stay 35.

Next, the used belt 31 is removed (process of removing used endless belt from image heating device). After the removal of the belt 31, the grease 130 on the heater 33 is wiped away (process of removing lubricant from belt contacting surface of heater 33). Therefore, the belt contacting surface of the heater 33 is coated with a fresh supply of lubricant. During this process, the area 33A or 33C is coated with virtually no grease 130, whereas the areas B are coated with the grease 130 (process of coating heater 33 with grease 130).

The amount of grease 130 coating the areas 33B per unit area during this process is desired to be no less than 0.3 mg/mm$^2$ and no more than 0.9 mg/mm$^2$. That is, the amount of grease 130 coating the areas 33B per unit length in terms of the heater length direction is desired to be no less than 1.5 mg/mm and no more than 4.5 mg/mm. Further, the small amount of grease 130 coating the area 33C per unit area is desired to be no more than 0.2 mg/mm$^2$. That is, the small amount of grease 130 coating the area 33C per unit length in terms of the heater length direction is desired to be no more than 1.0 mg/mm. Further, the length L (range across which heater is coated) of the area 33C is desired to be no less than 10 mm and no more than 70 mm (10 mm L 70) (ratio of L relative to length of effective heat generation range of heater 33 is desired to be no less than 3% and no more than 21%).

Then, a brand-new belt 31 is fitted around the combination of the guiding member 34 by which the heater 33 is held, and the pressure application stay 35 (process of attaching replacement belt 31 to image heating device).

Next, the removed flange 36A or 36B is reattached to reassemble the belt unit 30. Then, this reassembled belt unit 30 is reattached to the casing of the fixing device 40.

By the way, it is recommendable to put the printer 1 through a break-in operation after the belt replacement, in order to allow the brand-new belt 31 to be uniformly coated with the grease 130.

By replacing the belt 31 as describing above, it is possible to make a used fixing device 40 as effective as a brand-new one.

That is, according to this embodiment, it is possible to prevent the occurrence of the belt slip attributable to the increase in the amount of torque necessary to rotate the belt 31. Also according to this embodiment, it is possible to prevent the occurrence of a significant amount of difference between the temperature detected by the thermistor TH and the belt surface temperature. Therefore, it is possible to prevent the occurrence of unsatisfactory fixation.

Embodiment 2

Figure 11:
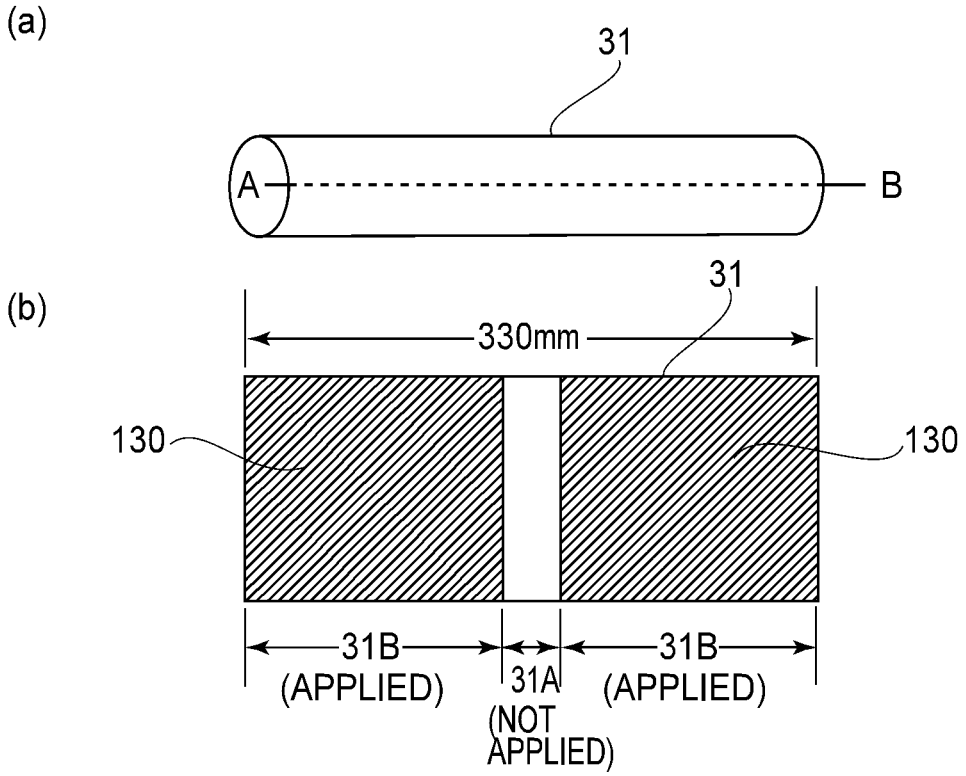
FIG. 11 is a drawing for illustrating the pattern in which lubricant was applied on the inward surface of the belt in the second embodiment of the present invention.

The structure of the fixing device 40 in the second embodiment is roughly the same as that in the first embodiment. Therefore, the only significant differences between the two devices 40 are described. That is, the structural components of the fixing device 40 in the second embodiment, which are similar in structure to the counterparts in the first embodiment, are given the same reference characters as those given to the counterparts, and are not described in detail. In the first embodiment, the belt contacting surface of the heater 33 is coated with the grease 130 in advance. In comparison, in this embodiment, it is the inward surface of the belt 31 that is coated with the grease 130 in advance. By configuring the fixing device 40 as described above, this embodiment makes it possible to replace the belt 31 in the same manner as in the first embodiment. FIG. 11(*a*) is an external view of the belt 31. FIG. 11(*b*) is a plan view of the belt 31, extended at a line A-A in FIG. 11(*a*), and is for illustrating the areas of the inward surface of the belt 31, which are to be coated with grease.

Referring to FIG. 11(*b*), in this embodiment, the areas 31B, which correspond in position to the areas 33B of the heater 33 are coated with the grease 130 in advance. The area 31A of the inward surface of the belt 31, which corresponds in position to the area 33A of the heater 33A, is not coated with the grease 130. In this embodiment, the dimension of the area 31A of the inward surface of the belt 31 is 30 mm in terms of the belt length direction. The areas 31B of the inward surface of the belt 31 are entirely coated with the grease 130; the inward surface of the belt 31 is coated with the grease 130, except for the area 31A. By the way, the belt 31 is 30 mm in internal diameter, and 330 mm in width (in lengthwise direction of fixing device 40). The areas 31B of the inward surface of the belt 31 are coated with the grease 130 by 2.0 mg/mm per unit length, in terms of the belt width direction. Since the diameter of the belt 31 is 30 mm, the belt 31 is roughly 94.2 mm in dimension in terms of its circumferential direction. Therefore, the amount, per unit area, of the grease 130 on the areas 31B is 21 μm/mm$^2$. Coating the inward surface of the belt 31 with the grease 130 in such a manner that a preset area of the inward surface is not coated at all makes it easier to control the belt coating process, and also, to manage the inventory, than coating the inward surface 31 with grease 130 in such a manner that the preset area is coated with a smaller amount of the grease 130 than the rest. However, even if the area 31A of the inward surface of the belt 31 is coated with a very small amount of the grease 130, the same effects as those obtainable by this embodiment can be obtained. Therefore, the area 31A (or area 31C, which will be described later) may be coated with a very small amount of grease 130. In such a case, the amount of grease 130 coating the area 31A (or area 31C) is desired to be no more than 1.0 mg/mm in terms of the belt width direction (no more than 10 μg/mm2, per unit area), like the amount of grease 130 coating the area 33A of the heater 33 in the first embodiment. The amount of grease 130 coating areas 31B of the inward surface of the belt 31 per unit area is desired to be no less than 1.5 mm/mm and no more than 4.5 mg/mm (no less than 16 μg/mm$^2$ and no more than 47 μg/mm$^2$, per unit area), as in the case of the above described first embodiment. Therefore, in a case where the area 31A is coated with a very small amount of the grease 130, the amount of grease 130 coating the area 31A per unit area is desired to be no more than ⅔ the amount of grease 130 coating the areas 31B per unit area.

The method for replacing the belt 31 of the fixing device 40 (method for replacing endless belt of image heating device) is as follows. First, the belt unit 30 is removed from the casing 50 of the fixing device 40, and either the flange 36A or 36B is removed. With the removal of the flange 36A or 36B, it is possible to remove the used belt 31 fitted around the combination of the guiding member 34 and the pressure application stay 35.

Then, the used belt 31 is removed (process of removing used endless belt from image heating device). After the removal of the belt 31, the grease 130 on the heater 33 is wiped away (process of removing lubricant from belt contacting surface of heater 33). Thereafter, a brand-new belt 31, which has been partially coated with the grease 130 is fitted around the combination of the guiding member 34 by which the heater 33 is held, and pressure application stay 35 (process of attaching replacement endless belt to image heating device).

Then, the removed flange 36A or 36B is reattached to reassembled the belt unit 30. Then, the reassembled belt unit 30 is reattached to the casing 50 of the fixing device 40.

Then, electric power was supplied to the heater 33 of the fixing apparatus 40, into which the belt 31 in this embodiment was installed, and which was therefore as good as a brand-new fixing device, as in the experiments in which the fixing device 40 in the first embodiment, was tested, and the belt temperature, and the temperature $T_{heat}$ detected by the thermistor TH were obtained to confirm the temperature increase curve. Further, as the second example of comparative belt 31, a brand-new belt 31 coated with the grease 130 across the entirety of its inward surface was installed in the fixing device 40. Then, the belt temperature and the temperature $T_{heat}$ measured by the thermistor TH were obtained to confirm the temperature increase curve. In the case of the second example of comparative belt 31, both the area 31A and areas 31B, that is, the entirety of the inward surface of the belt 31, were uniformly coated with the grease 130 by 2.0 mg/mm per unit length (20 μg/mm$^2$ per unit area).

As a result, in the case where the area 31A is small in the amount by which it is coated with the grease 130 (embodiment 2), when the temperature $T_{heat}$ detected by the thermistor TH reached 200° C., the surface temperature of the belt 31 had reached 171° C. In comparison, in the case where the grease 130 was uniformly applied to both the area 31A and areas 31B, that is, the entirety of the inward surface of the belt 31 (comparative example 2), when the temperature $T_{heat}$ detected by the thermistor TH reached 200° C., the surface temperature of the belt 31 had reached only 160° C. This result is attributable to the fact that in the case of the second example of the comparative belt 31, the area 33A is large in the amount of the grease 130, and therefore, the heater 33 increases in temperature faster than the belt 31; the heater 33 alone increased in temperature before the heat generated by the heater 33 was satisfactorily transmitted to the belt 31. That is, there occurred a significant amount of difference between the temperature $T_{heat}$ detected by the thermistor TH and the surface temperature of the belt 31.

As described above, in this embodiment, in order to ensure that the area 31A of the inward surface of the belt 31, which corresponds to the area 33A of the belt contacting surface of the heater 33, remains free of the grease 130, the inward surface of the belt 31 is coated with the grease 130 in the above-described manner. In this embodiment, therefore, it is possible to prevent the occurrence of the belt slip attributable to the increase in the amount of torque necessary to rotate the belt 31. Further, in this embodiment, it is possible to prevent the problem that the belt does not increase in temperature as fast as desired when an undesirably large amount of grease 130 is between the heater 33 and the belt 31, for example, when a fixing device is brand-new and/or immediately after the belt 31 was replaced. Therefore, it is possible to prevent the above-described unsatisfactory fixation.

Figure 12:
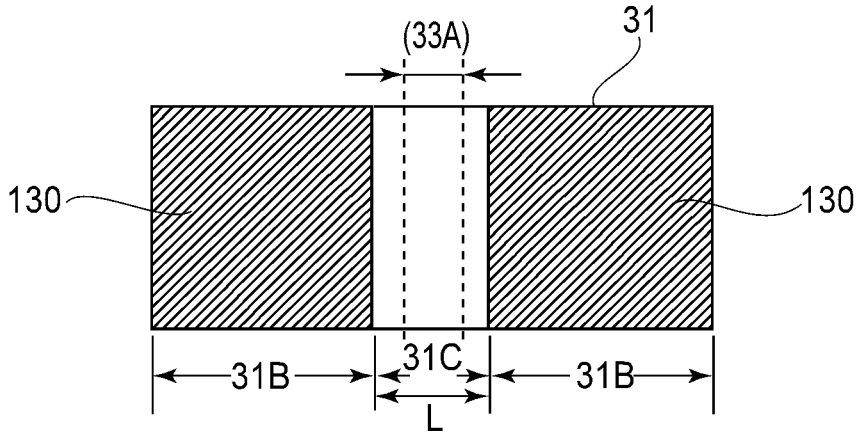
FIG. 12 is a drawing for illustrating another pattern in which lubricant was applied to the inward surface of the belt.

FIG. 12 is a modified version of the pattern in which the inward surface of the belt 31 is coated with the grease 130 in this embodiment. This modified version is different from this embodiment in the range of the inward surface of the belt 31, which is coated with virtually no grease 130. That is, in the case of the modified version, in terms of the belt width direction, the area 31C of the inward surface of the belt 31, which includes the area 31A of the inward surface of the belt 31, which corresponds in position to the thermistor TH, is coated with virtually no grease 130. Also in the case of the modified version, the areas 31B (second areas) of the inward surface of the belt 31, that is, the areas of the inward surface of the belt 31, which are not the preset area 31C, are coated with a preset amount of grease 130. The amount by which the area 31B is coated with the grease 130 per unit length is desired to be no less than 1.5 mg/mm and no more than 4.5 mg/mm.

In the case of the modified version, the area 31C was coated with the grease 130 by 0.5 mg/mm per unit length. This area 31C was varied in length L (range). Then, each variation was tested for the initial performance in fixation. Then, each variation was tested for the occurrence of the belt slip after the fixing device was used for a substantial length of time. The results of the tests are given in FIG. 10.

Also in the case of the modified versions of this embodiment, the width L of the area 31C was varied. Then, each variation was tested for the initial performance in fixation, and also for the occurrence of the belt slip after the fixing device was used for fixation for a substantial length of time, as the modified version of the first embodiment, shown in FIG. 9, was tested. The results of the tests were the same as those from the embodiment 1. That is, it became evident from the results of the tests that in terms of the width direction of the belt 31, the width L of the area 31C of the inward surface of the belt 31 is desired to be no less than 10 mm and no more than 70 mm (no less than 3% and no more than 21% in its ratio relative to dimension of belt 31 in width direction (10 mm≤L≤70 mm)).

As described above, according to this embodiment, it is possible to prevent the occurrence of the belt slip attributable to the increase in the amount of torque necessary to rotate the belt 31. Also, according to this embodiment, it is possible to prevent the occurrence of a difference between the temperature detected by the thermistor TH and the surface temperature of the belt 31, and it is possible to prevent the occurrence of unsatisfactory fixation.

[Miscellanies]

The choice of the heater 33 as a heating member does not need to be limited to a ceramic heater. That is, any heater may be employed as long as it is of such a structure that it contacts the inward surface of the belt 31. For example, the choice of heater 33 may be a magnetic member which can be heated by electromagnetic induction with the use of an excitation coil, or a Nichrome heater.

The fixing devices 40 in the first and second embodiments were structured so that when a sheet P of a recording medium is conveyed through the device 40, the center of the sheet P coincides with the centerline of the recording medium conveyance passage of the fixing device 40, in terms of the direction which is perpendicular to the recording medium conveyance direction, or one of the edges of the sheet P remains in contact with the corresponding edge of the recording medium conveyance passage.

Further, in the first and second embodiments, the fixing devices 40 were examples of an image heating device for heating an unfixed toner image on a sheet P of recording paper. However, these embodiments are not intended to limit the present invention in scope. For example, the present invention is also applicable to an image heating device for heating a fixed toner image on a sheet of recoding medium to increase the toner image in gloss.

As described above, according to the first and second embodiments, it is possible to prevent the problem that the belt 31 is caused to slip by the increase in the amount of torque necessary to rotate the belt 31, which is attributable to the friction between the belt 31 and the heater 33. Further, according to the first and second embodiments, it is possible to prevent the occurrence of a difference between the temperature detected by the thermistor TH and the surface temperature of the belt 31, and it is possible to prevent the occurrence of the unsatisfactory fixation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2014-095811 filed on May 7, 2014 and 2015-087912 filed on Apr. 22, 2015, which are hereby incorporated by reference herein in their entirety.

What is claimed is:

1. An image heating apparatus comprising:

an endless belt configured to heat an image on a sheet in a nip;

a heater configured to heat said belt, said heater being cooperative with said belt to form a sliding portion between an inner surface of said belt and said heater;

a rotatable member cooperative with said heater to sandwich said belt to form said nip between an outer peripheral surface of said belt and said rotatable member;

a detecting member provided on a surface of said heater relatively remoter from said sliding portion than said heater and configured to detect the temperature of said heater;

a controller configured to control the timing of feeding the sheet to said nip on the basis of an output of said detecting member; and lubricant provided in at least a part of said sliding portion except for a range which is in opposing relation with said detecting member, wherein said sliding portion is free of the lubricant in the range.

2. An apparatus according to claim 1, wherein said sliding portion is free of the lubricant in a predetermined area including the range, and the lubricant is provided outside the predetermined area, with respect to a longitudinal direction.

3. An image heating apparatus comprising:

an endless belt configured to heat an image on a sheet in a nip;

a heater configured to heat said belt, said heater being cooperative with said belt to form a sliding portion between an inner surface of said belt and said heater;

a rotatable member cooperative with said heater to sandwich said belt to form said nip between an outer peripheral surface of said belt and said rotatable member;

a detecting member provided on a surface of said heater relatively remoter from said sliding portion than said heater and configured to detect the temperature of said heater;

a controller configured to control the timing of feeding the sheet to said nip on the basis of an output of said detecting member;

first lubricant provided in said sliding portion in a position in an opposing relation with said detecting member; and second lubricant provided in said sliding portion in a position in a non-opposing relation with said detecting member, wherein the amount of said first lubricant per unit area is smaller than that of said second lubricant.

4. An apparatus according to claim 3, wherein said first lubricant is provided in a predetermined area including a range which is in an opposing relation with said detecting member, and said second lubricant is provided in an area outside the predetermined area.

5. An apparatus according to claim 3, wherein the amount of lubricant per unit area is not more than ⅔ of the amount of said second lubricant per unit area.

6. An apparatus according to claim 3, wherein the amount of said first lubricant per unit area is not more than 0.2 mg/mm^2.

7. An apparatus according to claim 6, wherein the amount of said second lubricant per unit area is not less than 0.3 mg/mm^2 and not more than 0.9 mg/mm^2.

8. An apparatus according to claim 3, wherein said first lubricant and said second lubricant are fluorine grease.

9. A heater capable of contacting a belt of an image heating apparatus to heat the belt, said heater comprising:

a substrate having a first surface contactable to said belt;

a heat generating element provided on said substrate and extending in a longitudinal direction;

a detecting member provided on a second surface of said substrate opposite said first surface and configured to detect the temperature of said substrate; and lubricant provided on at least a part of said first surface except for a range which is in an opposing relation with said detecting member, wherein said first surface is free of the lubricant in the range.

10. An apparatus according to claim 9, wherein said sliding portion is free of the lubricant in a predetermined area including the range, and the lubricant is provided outside the predetermined area, with respect to a longitudinal direction.

11. A heater capable of contacting a belt of an image heating apparatus to heat the belt, said heater comprising:

a substrate having a first surface contactable to said belt;

a heat generating element provided on said substrate and extending in a longitudinal direction;

a detecting member provided on a second surface of said substrate opposite said first surface and configured to detect the temperature of said substrate;

first lubricant provided said first surface in a position in an opposing relation with said detecting member; and second lubricant provided on said first surface in a position in a non-opposing relation with said detecting member, wherein the amount of said first lubricant per unit area is smaller than that of said second lubricant.

12. An apparatus according to claim 11, wherein said first lubricant is provided in a predetermined area including a range which is in an opposing relation with said detecting member, and said second lubricant is provided in an area outside the predetermined area.

13. An apparatus according to claim 11, wherein the amount of lubricant per unit area is not more than ⅔ of the amount of said second lubricant per unit area.

14. An apparatus according to claim 11, wherein the amount of said first lubricant per unit area is not more than 0.2 mg/mm^2.

15. An apparatus according to claim 14, wherein the amount of said second lubricant per unit area is not less than 0.3 mg/mm^2 and not more than 0.9 mg/mm^2.

16. An apparatus according to claim 11, wherein said first lubricant and said second lubricant are fluorine grease.

17. An exchanging method for exchanging a belt, in an image heating apparatus including the belt which is an endless belt configured to heat an image on a sheet in a nip, a heater having a first surface contactable to an inner surface of the belt to heat the belt, a rotatable member cooperative with the heater to sandwich the belt to form the nip between an outer peripheral surface of the belt and the rotatable member, a detecting member provided on a second surface of the heater opposite the first surface and configured to detect the temperature of the heater, and a controller configured to control the timing of feeding the sheet to the nip on the basis of an output of the detecting member, said method comprising:

a step of removing the belt having been used up, from said image heating apparatus;

a step of applying lubricant to the first surface of said heater; and a step of mounting a fresh belt to said image heating apparatus, wherein said applying step comprises applying the lubricant on at least a part of said first surface except for a range which is in an opposing relation with said detecting member, wherein said first surface is free of the lubricant in the range.

18. An exchanging method for exchanging a belt, in an image heating apparatus including the belt which is an endless belt configured to heat an image on a sheet in a nip, lubricant applied on an inner peripheral surface of the belt, a heater having a first surface contactable to an inner surface of the belt to heat the belt, a rotatable member cooperative with the heater to sandwich the belt to form the nip between an outer peripheral surface of the belt and the rotatable member, a detecting member provided on a second surface of the heater opposite the first surface and configured to detect the temperature of the heater, and a controller configured to control the timing of feeding the sheet to the nip on the basis of an output of the detecting member, said method comprising:

a step of removing the belt having been used up, from said image heating apparatus; and a step of mounting a fresh belt to said image heating apparatus, wherein the lubricant is provided on at least a part of an inner surface of the fresh belt except for a range which is in an opposing relation with said detecting member when said image heating apparatus heats the image, wherein the inner surface of the belt is free of the lubricant in the range.

* * * * *